US006402284B1

(12) United States Patent
Merz

(10) Patent No.: US 6,402,284 B1
(45) Date of Patent: Jun. 11, 2002

(54) METHOD AND APPARATUS FOR DETECTING INK TANK CHARACTERISTICS

(75) Inventor: Eric A. Merz, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/327,622

(22) Filed: Jun. 8, 1999

(51) Int. Cl.[7] ..... B41J 29/393; B41J 2/14; B41J 2/175

(52) U.S. Cl. ..... 347/19; 50/86

(58) Field of Search ..... 347/119, 86, 49, 347/7, 43, 87, 50; 73/323; 250/577; 385/36

(56) References Cited

U.S. PATENT DOCUMENTS

| | | | |
|---|---|---|---|
| 4,743,902 A | 5/1988 | Andermo | |
| 5,374,132 A | 12/1994 | Kimura | |
| 5,583,545 A | 12/1996 | Pawlowski, Jr. et al. | |
| 5,886,519 A | 3/1999 | Masreliez et al. | |

FOREIGN PATENT DOCUMENTS

| | | | | |
|---|---|---|---|---|
| DE | 3422504 A1 | | 1/1986 | |
| DE | 196 42 899 A1 | | 10/1997 | |
| EP | 0 412 459 A2 | | 2/1991 | |
| EP | 0 812 693 A1 | | 12/1997 | |
| JP | 56 039414 | | 4/1981 | |
| JP | 62 263059 | | 11/1987 | |
| JP | 07 227972 | | 8/1995 | |
| JP | 0 823 575 5 | * | 9/1998 | ..... 73/323 |
| WO | WO 99/10180 | | 3/1999 | |

* cited by examiner

*Primary Examiner*—John Barlow
*Assistant Examiner*—Charles W. Stewart, Jr.
(74) *Attorney, Agent, or Firm*—Oliff & Berridge, PLC

(57) ABSTRACT

A particular ink tank, and therefore its characteristics, are determined by detecting the existence or absence of magnets at predetermined positions on the ink tank. The detection of the magnets is performed by hall effect sensors located on an ink tank holder of an image recording apparatus when the ink tank is positioned in the ink tank holder.

14 Claims, 3 Drawing Sheets

FIG. 1
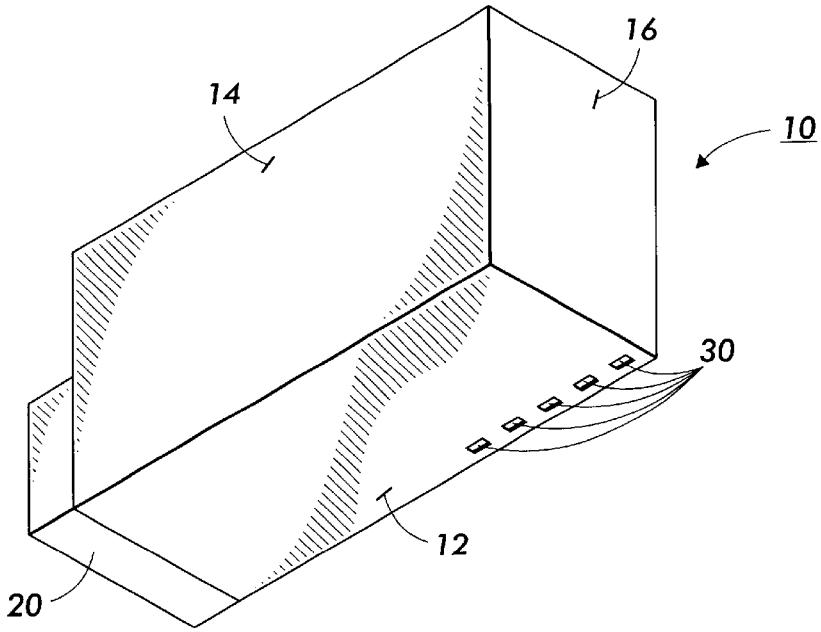
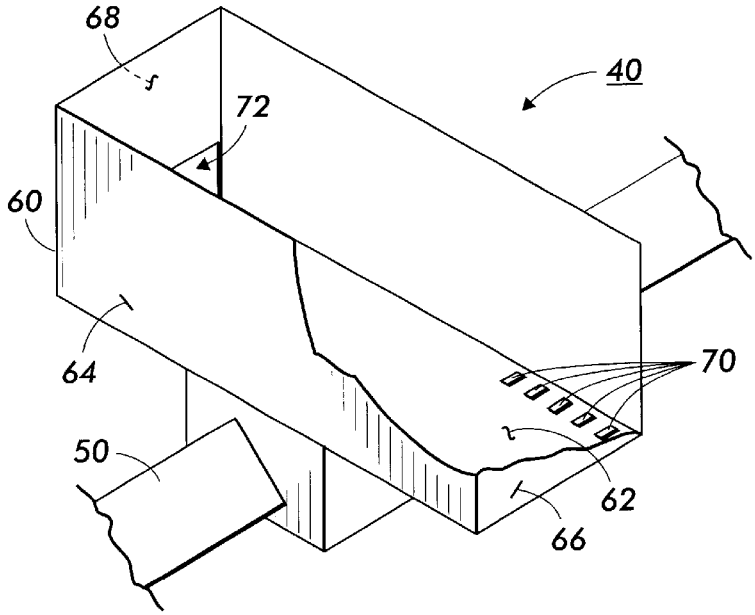
FIG. 2

FIG. 3
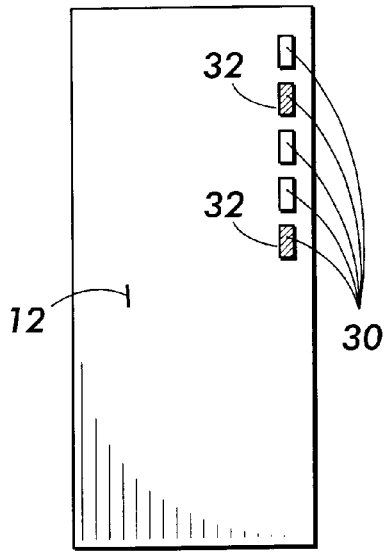
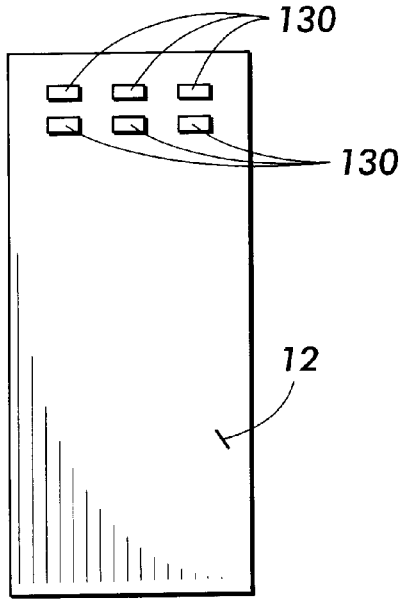
FIG. 4

FIG. 5
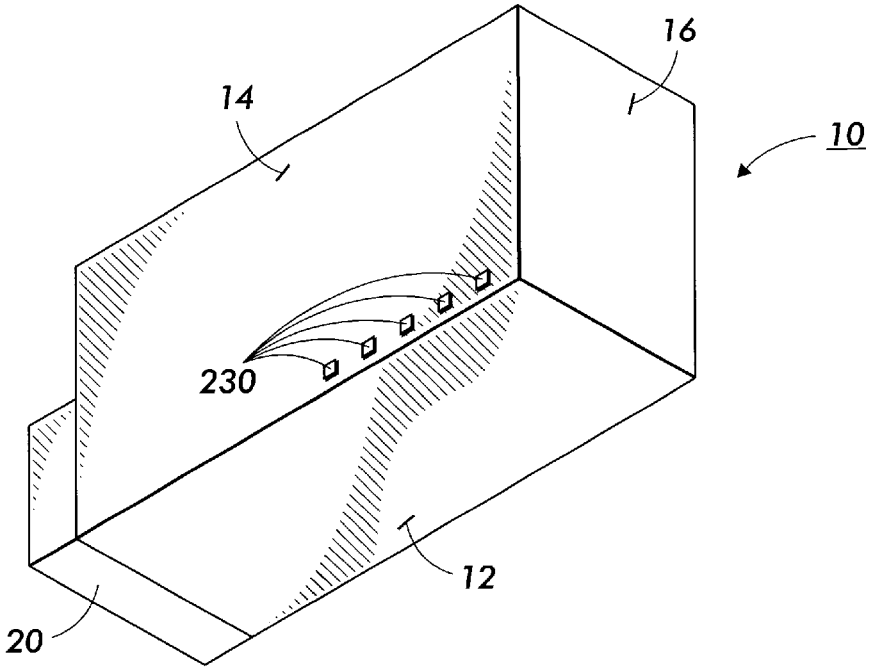
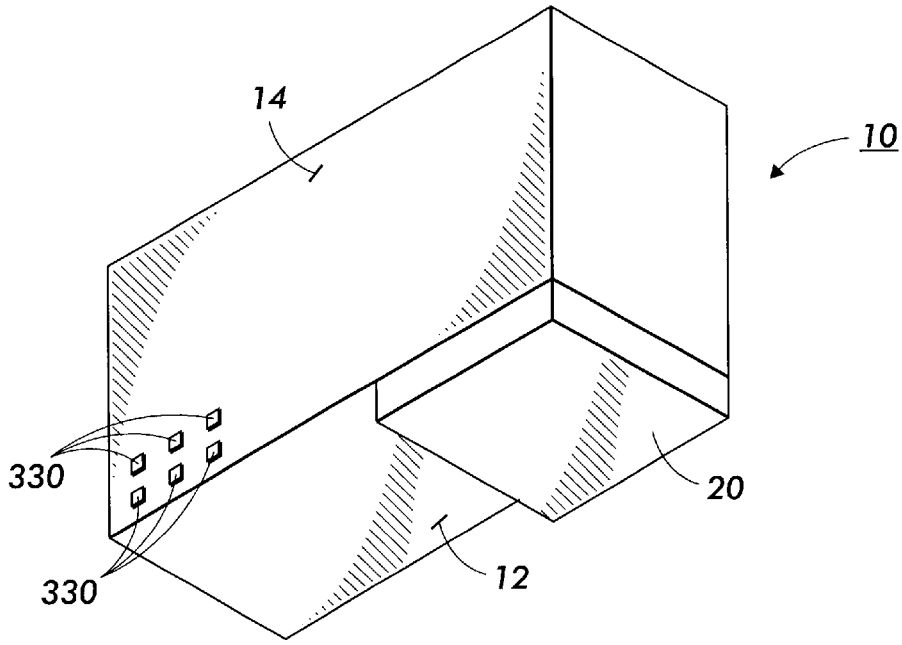
FIG. 6

METHOD AND APPARATUS FOR DETECTING INK TANK CHARACTERISTICS

BACKGROUND OF THE INVENTION

1. Field of Invention

The invention relates to the field of image recording. In particular, the invention relates to detecting characteristics of an ink tank used with an image recording apparatus.

2. Description of Related Art

Image recording devices such as, for example, ink jet printers, normally have a removable ink cartridge or tank that holds ink used in recording images.

Millions of ink tanks are sold each year for popular models of image recording devices. Some of the ink tanks can have different properties that result in different performance of the image recording device. For example, the ink within the ink tanks can have different properties or the ink tanks can have different capacities or ink flow rates. The differences in these and other properties or characteristics can cause operational problems in the image recording device. Therefore, there is a real need for a simple and efficient method and apparatus for determining ink tank characteristics.

Optical methods exist for detecting different ink tanks used with an image recording device. Some of these optical methods are discussed in U.S. patent application Ser. No. 08/572,595 filed Dec. 14, 1995.

SUMMARY OF THE INVENTION

In order to distinguish between ink tanks having different characteristics but physically fitting in a particular image recording device, the invention provides an ink tank having a main body with a plurality of indicator positions located in the main body. Each of the plurality of indicator positions corresponds to a different one of a plurality of sensors in an ink tank holder of the image recording apparatus and each of the indicators can be detected by a corresponding one of the plurality of sensors. The invention also provides an image recording apparatus for use with such an ink tank.

The indicators can, for example, be magnets and the sensors can, for example, be Hall effect sensors. The invention has the advantages of being very inexpensive and allowing the detection of multiple different ink tanks.

These and other features and advantages of the invention are described in or are apparent from the following detailed description of the exemplary embodiments.

BRIEF DESCRIPTION OF THE DRAWINGS

The invention will be described in relation to the following drawings in which like reference numerals refer to like elements, and wherein:

FIG. 1 is a perspective view of an ink tank of the invention;

FIG. 2 is a perspective view of an ink tank holder of an image recording apparatus of the invention;

FIG. 3 is a bottom view of one exemplary embodiment of an ink tank of the invention;

FIG. 4 is a bottom view of another exemplary embodiment of an ink tank of the invention;

FIG. 5 is a perspective view of another exemplary embodiment of an ink tank of the invention; and FIG. 6 is a perspective view of another exemplary embodiment of an ink tank of the invention.

DETAILED DESCRIPTION OF PREFERRED EMBODIMENTS

One exemplary embodiment of an ink tank according to this invention has a plurality of indicator positions located on a main body of the ink tank. Each indicator position corresponds to a different one of a plurality of sensors located in an ink tank holder of an image recording apparatus. A number of indicators, from zero to the number of indicator positions, are attached to the main body of the ink tank at the indicator positions. Each of the indicators is detectable by a corresponding one of the sensors. By assigning a unique pattern of the number and location of the indicators within the indicator positions to a particular type of ink tank, the image recording apparatus can determine whether a specific ink tank loaded into the image recording apparatus is that type of particular ink tank. This determination is possible because the sensors detect which indicator positions are occupied by indicators. This information is compared to stored identification data correlating each possible pattern of indicators with a particular type: of ink tank.

Other exemplary embodiments of the invention provide an image recording apparatus for use with the ink tank described above.

Still other exemplary embodiments of the invention provide an image recording apparatus including the ink tank described above.

In the above outlined exemplary embodiments, the indicators can be, for example, magnets. In general, any known or later developed unpowered structure can be used as indicators in place of magnets. The sensors can be any sensor that can detect the indicators used. Where magnets are used as the indicators, Hall effect sensors can be used as the sensors. Capacitive coupling structures can be used wherein, for example, a pair of connected capacitor plates are attached to the ink tank as an indicator and an energy source and a sensor are attached to the ink tank holder adjacent the pair of capacitor plates. Examples of such capacitive coupling structures and sensors are shown in U.S. Pat. No. 4,743,902. Similarly, inductive coupling structures can be used. Examples of such inductive coupling structures and sensors are shown in U.S. Pat. No. 5,886,519. Another example of an acceptable structure is a mechanical structure in which each sensor is a plunger that can be activated by an indicator that is at a different elevation than non-indicator indicator positions. For example, an indicator position that is designated as a non-indicator can be a depression that does not activate the corresponding plunger. In contrast, an indicator position that is designated as an indicator can be at an elevation that activates the corresponding plunger. Activating the plunger can open or close a switch or break an optical path and, therefore, create a signal to be sent to a processor. An example of such a mechanical structure is shown in U.S. Pat. No. 5,374,132. Examples of other types of sensors include mirrors, beam blockers and conductive brush contacts.

The magnets can be constructed as, for example, permanent magnets insert-molded into the ink tank, permanent magnet pieces mechanically inserted into the pre-formed indicator positions, or magnetizable material inserted into all indicator positions with the material at only those indicator positions associated with the particular ink tank being selectively magnetized.

Any number of indicator positions and sensors can be used as long as they physically fit on the ink tank and on the ink tank holder. In some embodiments, five indicator positions are located in a straight line on the main body of the ink tank. An image recording apparatus corresponding to this embodiment would have five sensors arranged in a straight line at a location on the ink tank holder such that the sensors are adjacent the indicator positions when the ink tank is installed in the ink tank holder. In embodiments having five sensors, the number of different types of ink tanks detectable is 32 ($2^5$). If six sensors are used, the number different types of ink tanks detectable is 64 ($2^6$).

FIGS. 1 and 2 show one exemplary embodiment of the invention in which five sensors and five indicator positions are used. In FIG. 1, an ink tank 10 has a bottom surface 12, a side surface 14 and an end surface 16. An exemplary printhead 20 is shown, attached to a surface of the ink tank 10 opposite the end surface 16. The printhead 20 can also be attached to a different surface of the ink tank 10. In some embodiments, the ink tank 10 will not have a printhead 20 because the printhead is a part of the image recording apparatus instead of a part of the ink tank 10. The exemplary embodiment shown in FIG. 1 has five indicator positions 30 arranged in a straight line on the bottom surface 12.

FIG. 2 shows a portion of an exemplary image recording apparatus 40, including a bar 50 and an ink tank holder 60 slidably mounted on the bar. This image recording apparatus 40 is only one example of an image recording apparatus usable with the invention. The ink tank holder 60 has a bottom surface 62, a side surface 64 and an end surface 66. In this exemplary embodiment, five sensors 70 are arranged in a straight line on the bottom surface 62.

The ink tank 10 shown in FIG. 1 slides into the ink tank holder 60 so that the bottom surface 12 of the ink tank 10 is adjacent the bottom surface 62 of the ink tank holder 60 such that the indicator positions 30 are adjacent the sensors 70. A portion of the side surface 64 and the end surface 66 of the ink tank holder 60 are shown broken away in FIG. 2 to more clearly show the sensors 70.

In normal operation, when the ink tank 10 is positioned in the ink tank holder 60 the printhead 20 protrudes from an opening 72 in a second end surface 68 such that the printhead 20 is in the proper position to record an image on a recording medium. In this position, each of the indicator positions 30 is positioned above one of the sensors 70 such that each sensor 70 can determine whether or not an indicator exists at each of the indicator positions 30. FIG. 3 shows a bottom view of bottom surface 12 of ink tank 10 in which indicators 32 are located at two of the five indicator positions 30.

When an ink tank 10 configured in accordance with FIG. 3 is located in the ink tank holder 60, the two sensors 70, corresponding to the two indicator positions 30 having indicators 32, send signals to a processor (not shown) indicating that indicators 32 exist at these two indicator positions 30. The other three sensors 70 in the ink tank holder 60 do not send such signals. Therefore, the processor determines that indicators 32 do not exist at these remaining three indicator positions 30. The pattern of indicators 32 shown in FIG. 3 can be associated with a particular type of ink tank having particular characteristics. These characteristics can be, for example, brand of manufacture, model number, ink color, ink density, ink flow rate, ink tank capacity, etc. Based on these characteristics, various functions of the printer can be adjusted to optimize performance of the printer.

FIGS. 4, 5 and 6 show additional exemplary embodiments of the invention in which the indicator positions 30 are located in different positions on the ink tank 10 and/or are oriented differently. In FIG. 4, six indicator positions 130 are arranged in a rectangular pattern on the bottom surface 12 of the ink tank 10. In FIG. 5, five indicator positions 230 are arranged in a straight line on the side surface 14 of the ink tank 10. In FIG. 6, six indicator positions 330 are arranged in a rectangular pattern on the side surface 14 of the ink tank 10. The indicator positions can also be located, for example, on the top or other surface of the ink tank. Also, in FIG. 6, the printhead 20 is shown in a different location than that of FIGS. 1 and 5 as one example of a different location for the printhead 20. The printhead 20, if it is attached to the ink tank 10, can be located in any appropriate position as long as the indicator positions 30 and the sensors 70 are located such that they do not interfere with the printhead 20.

The embodiments shown in FIGS. 1–6 are merely examples of the configurations of the indicator positions usable with the invention. It should be recognized that the ink tank 10 can be any appropriate shape, the print head 20 can be attached to the ink tank 10 at any appropriate position, or not attached to the ink tank at all, the indicator positions 30 can be located in any appropriate position on the ink tank 10, there can be as many indicator positions 30 as are needed to provide the required number of different combinations of indicators, the indicator positions 30 can be arranged in any appropriate pattern, and the sensors 70 can be in any number, pattern and location that appropriately corresponds to the number, pattern and location of the indicator positions 30.

While the invention has been described in conduction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. An image recording apparatus usable with an ink tank having a plurality of indicator positions, the image recording apparatus comprising:

an ink tank holder for holding the ink tank; and a plurality of sensors in the ink tank holder, each of the plurality of sensors corresponding to a different one of the indicator positions of the ink tank and for detecting whether an indicator exists at the corresponding indicator position on the ink tank;

wherein the plurality of sensors are Hall effect sensors.

2. The image recording apparatus of claim 1, wherein the plurality of sensors is five sensors.

3. The image recording apparatus of claim 1, wherein the plurality of sensors are arranged in a straight line.

4. An image recording apparatus, comprising:

an ink tank having a plurality of indicator positions and a number of indicators located at the indicator positions;

an ink tank holder for holding the ink tank; and a plurality of sensors in the ink tank holder, each of the plurality of sensors corresponding to a different one of the indicator positions of the ink tank and detecting whether one of the number of indicators exists at the corresponding indicator position on the ink tank;

wherein the plurality of sensors are Hall effect sensors.

5. The image recording apparatus of claim 4, wherein the plurality of sensors is five sensors.

6. The image recording apparatus of claim 5, wherein the five sensors are arranged in a straight line.

7. The image recording apparatus of claim 4, wherein the indicators are magnets.

8. The image recording apparatus of claim 4, wherein a magnetizable material is located at each indicator position and each of the indicators is a magnetized piece of the magnetizable material located at a particular one of the indicator positions.

9. A method of detecting characteristics of a particular ink tank mounted in an ink tank holder, comprising:

detecting, using a plurality of sensors located in the ink tank holder, whether an indicator exists at each of a plurality of indicator positions on the particular ink tank; and comparing detection results with indicator position information for various types of ink tanks to determine which of the various types of ink tanks corresponds to the particular ink tank;

wherein detecting is performed using a plurality of Hall effect sensors.

10. The method of claim 9, wherein each detected indicator is a magnet.

11. The method of claim 9, wherein the plurality of indicator positions is five indicator positions.

12. The method of claim 9, wherein the indicator positions are arranged in a straight line.

13. A detection system for detecting characteristics of a particular ink tank mounted in an ink tank holder, comprising:

means for detecting, using a plurality of sensors located in the ink tank holder, whether an indicator exists at each of a plurality of indicator positions on the particular ink tank; and means for comparing detection results with indicator position information for various types of ink tanks to determine which of the various types of ink tanks corresponds to the particular ink tank;

wherein the sensors are Hall effect sensors.

14. An image recording apparatus usable with an ink tank having at least one indicator position, the image recording apparatus comprising:

an ink tank holder for holding the ink tank; and at least one Hall effect sensor in the ink tank holder, each of the at least one Hall effect sensor corresponding to a different one of the at least one indicator position of the ink tank and for detecting whether an indicator exists at the corresponding indicator position on the ink tank.

* * * * *